United States Patent [19]

Radtke

[11] Patent Number: 4,815,427

[45] Date of Patent: Mar. 28, 1989

[54] FUEL ENRICHMENT SYSTEM

[75] Inventor: Norman H. Radtke, Fond du Lac, Wis.

[73] Assignee: Brunswick Corporation, Skokie, Ill.

[21] Appl. No.: 177,466

[22] Filed: Apr. 4, 1988

[51] Int. Cl.[4] ..... F02M 1/04

[52] U.S. Cl. ..... 123/179 G; 123/52 MB; 123/180 E; 123/580; 123/581

[58] Field of Search ..... 123/179 G, 180 R, 180 E, 123/180 T, 579, 580, 581, 52 MB, 187.5 R

[56] References Cited

U.S. PATENT DOCUMENTS

| | | | |
|---|---|---|---|
| 3,695,591 | 10/1972 | Caisley | 123/179 G |
| 3,742,922 | 7/1973 | Hisatomi et al. | 123/579 |
| 3,835,831 | 9/1974 | Ross | 123/179 G |
| 4,285,308 | 8/1981 | Hundertmark et al. | 123/187.5 R |
| 4,333,425 | 6/1982 | Kusche | 123/73 R |
| 4,509,472 | 4/1985 | Slattery | 123/179 G |
| 4,542,723 | 9/1985 | Fujimoto | 123/179 G |

FOREIGN PATENT DOCUMENTS

| | | | |
|---|---|---|---|
| 57-165647 | 10/1982 | Japan | 123/179 G |
| 57-206755 | 12/1982 | Japan | 123/179 G |

*Primary Examiner*—Andrew M. Dolinar

*Attorney, Agent, or Firm*—Andrus, Sceales, Starke and Sawall

[57] ABSTRACT

A fuel enrichment system for a multi-cylinder engine having a manifold balance line to deliver fuel to each of the cylinders as needed includes a valve located adjacent one of the carburetors to supply additional air/fuel mixture to approximately the center of the fuel balance line during the start-up of the engine.

7 Claims, 2 Drawing Sheets

FUEL ENRICHMENT SYSTEM

BACKGROUND OF THE INVENTION

The present invention relates to a fuel enrichment system and more particularly to an assembly for enriching the air/fuel mixture during the warm-up period of a multi-cylinder marine engine.

Prior cold start systems have used a variety of mechanical choke systems and fuel addition systems to enrich the air/fuel mixture for cold starting of internal combustion engines.

The prior art systems were not only mechanically complex but also had the drawback of requiring that the operator of the engine manually set a "warm-up" lever or manually push the choke switch or button. This increased the chances of flooding the engine or forgetting a necessary step in the starting procedure.

Carburetor associated enrichment valves of the type utilized in this invention have been used in single cylinder engines, but not in multi-cylinder engines.

SUMMARY OF THE INVENTION

The present invention provides a fuel enrichment system for a multi-cylinder engine that utilizes a manifold balance line to deliver a fuel and air mixture to each of the cylinders as needed.

In accordance with one aspect of the invention, the fuel enrichment system includes a valve located adjacent one of the carburetors and receiving fuel from the fuel reservoir of that carburetor. The valve includes an air inlet port and an air/fuel mixture outlet port.

In accordance with another aspect of the invention, the fuel enrichment system monitors the engine in order to detect whether or not the engine is in a start-up mode or in a running mode. When the engine is in a start-up mode, the valve is placed in an open position so as to introduce additional air/fuel mixture into the balance line.

In accordance with yet another aspect of the invention, the fuel enrichment system is provided with a conduit which connects the air/fuel mixture outlet port of the valve with substantially the center of the balance line.

The present invention thus provides a system that automatically enriches the fuel supply and provides for additional mixture to the balance line during the starting and/or warm-up period. Thus, relieving the operator of any manual activities such as setting levers or buttons during the start-up procedure.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
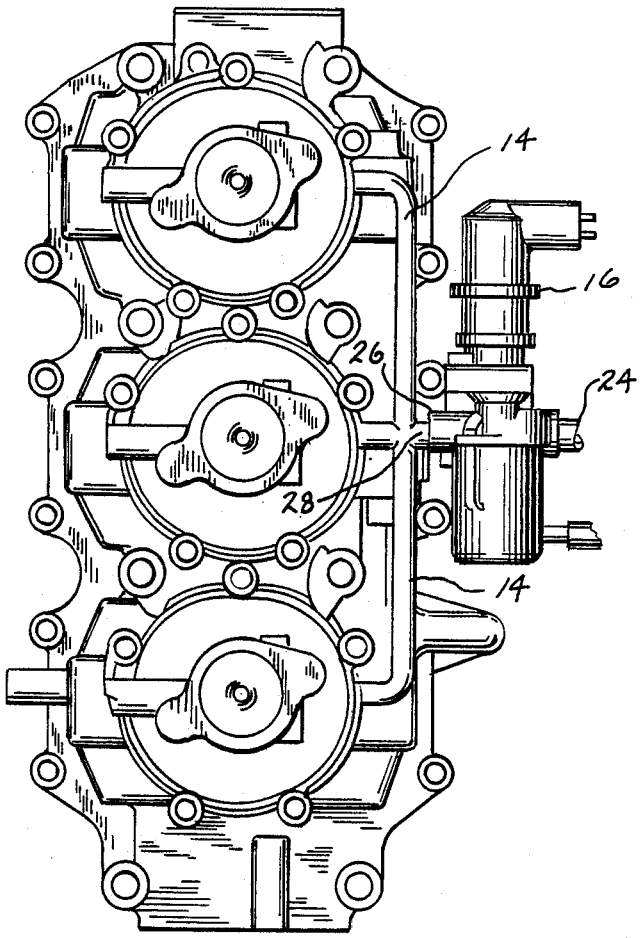
FIG. 1 is an elevational view of a multicylinder marine engine constructed according to the present invention.
Figure 2:
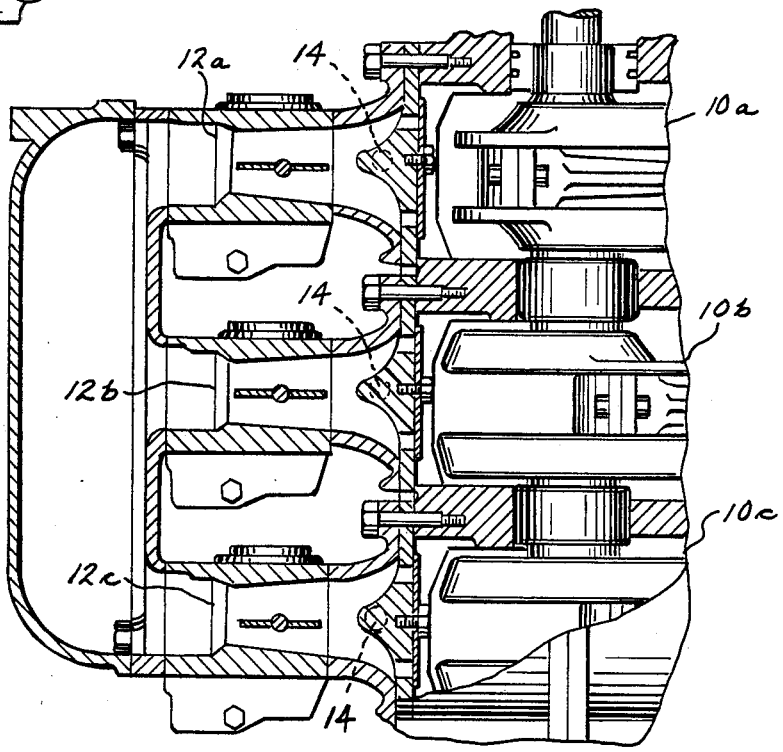
FIG. 2 is a partial sectional elevational view of the marine engine of FIG. 1.

As seen in FIG. 2, a marine internal combustion engine is provided with a plurality of piston containing cylinders 10a–10c which receive an air/fuel mixture from a series of associated carburetors 12a–12c. Since cylinders 10a–10c fire sequentially rather than in unison, a balance line 14 is provided. Balance line 14 insures that each of cylinders 10a–10c receives its needed air/fuel mixture prior to firing. Balance line 14 is utilized to obtain a more even balance between the flows through the carburetors of a multicarburetor system during low speed operation. The balance line connects the induction passages between the throttle valves and the reed valves. At low speeds (below 1000 rpms) the throttle valves are nearly closed and the pressures in the induction passages between the two valves would otherwise reflect variations in pressure resulting in mechanical differences between the cylinders. The balance line overcomes these pressure variations and provides a more balanced mixture to each of the cylinders.

During the initial start-up of the engine, it is desirable to enrich the air/fuel mixture in balance line 14 and to this end, a start-up valve 16 is positioned to the side of carburetor 12b in such a manner that fuel reservoir 18 of valve 16 is allowed to communicate with the fuel reservoir 20 of carburetor 12b through passage 19 so as to maintain a level of fuel 22 within reservoir 18 that is identical to that of the fuel level in carburetor 12b.

Figure 3:
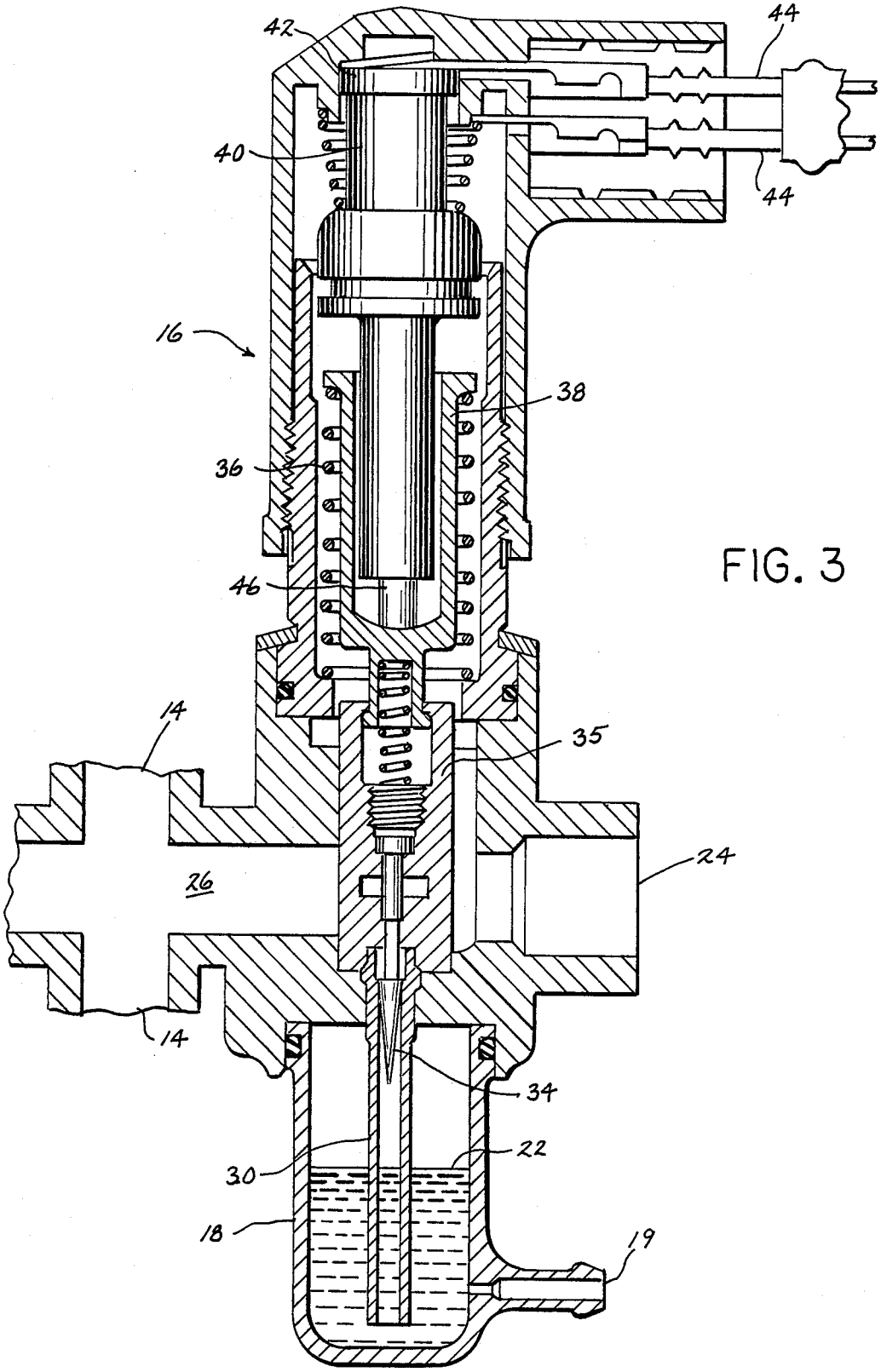
FIG. 3 is a side cross sectional view of the start-up valve utilized in the fuel enrichment system.

As seen in FIG. 3, start-up valve 16 is provided with an air inlet passage 24 and an air/fuel outlet passage 26. Outlet passage 26 is connected to substantially the center of balance line 14 by means of conduit 28.

Valve 16 is also provided with a fuel inlet passage 30 which when open allows fuel to be drawn up from reservoir 18 by the flow of air through inlet passage 24.

In FIG. 3, fuel passage 30 is shown closed by needle valve 34. In this state, no additional fuel is provided to balance line 14. However, in a cold start-up situation, needle valve 34 is biased upwardly by the action of spring 36 on housing 38 from which needle valve 34 extends.

The upper part of valve 16 includes a chamber 40 which contains a wax pellet (not shown) and which is in contact with an electrical heating element 42 that is energized by a flow of electrical current from electrical lines 44 that are connected to the alternator.

As heating element 42 becomes energized, the wax pellet in chamber 40 expands and causes pin 46 which is in engagement with housing 38 to move downwardly. The downward motion of pin 46 against housing 38 overcomes the biasing force of spring 36 and causes needle valve 34 and air valve 35 to move to their closed positions as shown in FIG. 3. Needle valve 34 is provided with a taper so that the flow of fuel through fuel inlet passage 30 is gradually reduced as valve 34 moves from an open position to a closed position.

At a cold start-up with temperatures lower than approximately 75° to 80° Farenheit, needle valve 34 and air valve 35 are biased to a wide open position by the action of spring 36 on housing 38.

The start-up valve 16 begins the start-up sequence with fuel at level 22 in the reservoir 18. Since the needle valve 34 and air valve 35 are fully open, the fuel is quickly drawn down below the bottom of fuel passage 30 to provide a substantial quantity of fuel for starting the engine. After the fuel level has been drawn down, the orifice 31 limits the fuel flow through passage 19 to the reservoir 18 to calibrate the fuel flow and provide the desired air/fuel mixture for cold running. Thus, during start-up, additional fuel is supplied through passage 30 and additional air is supplied through passage 35; so that an enriched air/fuel mixture is supplied to the center of balance line 14. As the engine continues to run and current flows through heating element 42, the wax pellet will expand and needle valve 34 will gradually be moved to a closed position.

As the needle valve 34 closes, fuel flow through passage 30 is gradually reduced, thus allowing the flow through passage 19 to refill the reservoir 18 to level 22 before the needle valve 34 fully closes passage 30. Needle valve 34 is fully closed at a temperature of approximately 170° Farenheit and needle valve 34 moves from a fully open position to a fully closed position in approximately 40 seconds.

The present invention thus provides a fully automated fuel enrichment system that delivers an enriched air/fuel mixture to approximately the center of the balance line for a multi-cylinder engine.

It is recognized that various alternatives and modifications are possible in the scope of the appended claims.

I claim:

1. The fuel enrichment system for a multi-cylinder engine having a manifold balance line to deliver a starting mixture to each cylinder as needed and a series of carburetors which deliver an air/fuel mixture to the engine, said system comprising:

valve means located adjacent one of the carburetors and having a fuel reservoir communicating with and receiving fuel from the fuel reservoir of the carburetor, said valve means having an air inlet port, a fuel inlet port and an air/fuel mixture outlet port and sealing means movable between a first position in which said fuel inlet port is open and a second position in which said fuel inlet port is closed, detection means for monitoring whether the engine is in an initial start-up mode or in a running mode, said detection means operatively connected to said sealing means so as to place said sealing means in said first position when the engine is in an initial start-up mode and to place said sealing means in said second position when the engine is in a running mode, and conduit connecting said air/fuel mixture outlet port with substantially the center of the balance line.

2. The fuel enrichment system defined in claim 1 wherein the engine includes an odd number of cylinders and associated carburetors in a line and said valve means is attached to the centrally located carburetor.

3. The fuel enrichment system defined in claim 1 wherein said detection means is operatively connected to the electrical system of the engine and the flow of electricity through said detection means generates heat and a first lower temperature is interpreted as an initial start up mode and a second higher temperature is interpreted as a running mode.

4. The fuel enrichment system defined in claim 3 wherein said detection means is connected to an engine driven supply source.

5. The fuel enrichment system defined in claim 1 wherein said sealing means is provided with a series of partially open and closed positions between said first open position and said second closed position.

6. The fuel enrichment system defined in claim 1 further comprising biasing means urging said sealing means to said first position.

7. The fuel enrichment system of claim 3 further comprising biasing means urging said sealing means to said first position and heat responsive means for overcoming said biasing means and moving said sealing means to said second position in response to said second higher temperature.

* * * * *